US007487729B2

(12) United States Patent
Riddiford et al.

(10) Patent No.: US 7,487,729 B2
(45) **Date of Patent: *Feb. 10, 2009**

(54) COMPUTER CONSOLE WITH ACCESSIBLE LAPTOP STORAGE COMPARTMENT

(75) Inventors: Martin Philip Riddiford, London (GB); Michael Andrew Nairn, London (GB)

(73) Assignee: David Arscott, Hampton, Middlesex (GB)

( * ) Notice: Subject to any disclaimer, the term of this patent is extended or adjusted under 35 U.S.C. 154(b) by 0 days.

This patent is subject to a terminal disclaimer.

(21) Appl. No.: 11/514,636

(22) Filed: Sep. 1, 2006

(65) Prior Publication Data

US 2007/0000414 A1 Jan. 4, 2007

Related U.S. Application Data

(62) Division of application No. 10/295,459, filed on Nov. 15, 2002, now Pat. No. 7,100,516.

(30) Foreign Application Priority Data

Jun. 28, 2002 (GB) ..... 0215053.0

(51) Int. Cl.
*A47B 37/00* (2006.01)

(52) U.S. Cl. ..... 108/50.01; 108/7

(58) Field of Classification Search ..... 108/50.01, 108/50.02, 7, 10, 3, 9; 312/223.6, 223.1, 312/223.2, 223.3
See application file for complete search history.

(56) References Cited

U.S. PATENT DOCUMENTS

| | | | |
|---|---|---|---|
| 226,842 | A | 4/1880 | Fitts et al. |
| 542,661 | A | 7/1895 | Thielemann |
| 615,130 | A | 11/1898 | Beckman |
| 707,675 | A | 8/1902 | Colburn |
| 1,645,769 | A | 10/1927 | Murray |
| 2,244,391 | A | 6/1941 | De Lisle |
| 4,695,104 | A | 9/1987 | Lederman |
| 4,705,438 | A | 11/1987 | Zimmerman et al. |
| 4,735,466 | A | 4/1988 | Wolters et al. |
| 4,735,467 | A | 4/1988 | Wolters |

(Continued)

FOREIGN PATENT DOCUMENTS

| | | |
|---|---|---|
| DE | 04100675 | 1/1991 |

(Continued)

OTHER PUBLICATIONS

UK website: Design GB2072893 Bibliography (M. Russell).

(Continued)

*Primary Examiner*—José V Chen
(74) *Attorney, Agent, or Firm*—Anderson Gorecki & Manaras LLP

(57) ABSTRACT

A console (10) is disclosed which comprises a console top (12), a first member (14), and a second member (16) coupled to the first member (14) via a mechanism. The mechanism (17) is movable between a first configuration in which the first member (14) closes a recess (18) in the console top (12), and a second configuration in which the first member (14) extends away from the console top (12) and the second member (16) is arranged such that it can support a load while the mechanism (17) is retained in the second configuration.

13 Claims, 19 Drawing Sheets

U.S. PATENT DOCUMENTS

| | | | |
|---|---|---|---|
| 4,766,422 | A | 8/1988 | Wolters et al. |
| 4,828,342 | A | 5/1989 | Stefan |
| 4,861,121 | A | 8/1989 | Gotz |
| 5,033,804 | A | 7/1991 | Faris |
| 5,120,117 | A | 6/1992 | Williams |
| 5,368,377 | A | 11/1994 | Baines |
| 5,415,010 | A | 5/1995 | Woo |
| 5,452,950 | A | 9/1995 | Crenshaw et al. |
| 5,480,224 | A | 1/1996 | Ugalde |
| 5,589,849 | A | 12/1996 | Ditzik |
| 5,699,225 | A | 12/1997 | Yavitz et al. |
| 5,746,489 | A | 5/1998 | Moon |
| 5,931,549 | A | 8/1999 | Lindberg |
| 5,957,059 | A | 9/1999 | Burhman |
| 6,059,385 | A | 5/2000 | Guhl |
| 6,076,473 | A | 6/2000 | Conte |
| 6,186,076 | B1 | 2/2001 | Sung |
| 6,237,507 | B1 | 5/2001 | Yanagisawa et al. |
| 6,286,440 | B1 | 9/2001 | Jyringi |
| 6,508,526 | B2 | 1/2003 | Reppas et al. |
| 6,553,919 | B1 | 4/2003 | Nevin |
| 6,802,577 | B2 | 10/2004 | Gershfeld |

FOREIGN PATENT DOCUMENTS

| | | | |
|---|---|---|---|
| DE | 4115151 | | 11/1992 |
| EP | 0995369 | | 4/2000 |
| GB | 758110 | | 9/1956 |
| GB | 863747 | | 3/1961 |
| GB | 2150017 | | 6/1985 |
| GB | 2172498 | | 9/1986 |
| GB | 2215197 | | 9/1989 |
| GB | 2215197 | A * | 9/1989 |
| GB | 2139467 | | 5/1998 |
| GB | 2356796 | | 6/2001 |
| WO | WO 97/15213 | | 5/1997 |
| WO | WO 98/05244 | | 2/1998 |
| WO | WO 99/29211 | | 6/1999 |
| WO | WO 01/43590 | | 6/2001 |
| WO | WO 02/062178 | | 8/2002 |

OTHER PUBLICATIONS

UK website: Design GB2072894 Bibliography (M. Russell).
UK website: Design GB2062244 Bibliography (International Computers Ltd.)

* cited by examiner

COMPUTER CONSOLE WITH ACCESSIBLE LAPTOP STORAGE COMPARTMENT

This is a divisional application based on and claiming priority from U.S. patent application Ser. No. 10/295,459, filed Nov. 15, 2002 now U.S. Pat. No. 7,100,516.

The present invention, relates to consoles, more particularly, but not limited to stowable computer consoles or desks.

Computer desks generally comprise a stand for supporting; a monitor and a surface on which a keyboard, mouse or other input device can be placed. It is known to provide a desk in which an LCD monitor is mounted on a foldable cover unit, which can be folded down into a recess in a desk to provide a flat desk working area. The keyboard can be housed in the recess when the cover unit is folded down. However, the cover unit cannot be folded down when the computer is in use as the screen would not be visible. Therefore the area of desk where the recess is located is unusable when the computer is deployed.

It is therefore an object of the present invention to remove or ameliorate at least one of the problems of the prior art, or to provide a useful alternative.

A console can be any type of desk, table or workstation or the like and is not limited to the specific description of it herein. The console of the present invention may be mounted in a kitchen worktop, or in a lecture theatre or seminar room desk, or in a hotel room. Several consoles may be placed in a single unit, such as a lecture theatre desk. The console may be adapted for use with a computer games console in a child's desk or other piece of domestic furniture.

The console may be used in a wide variety of locations: schools, hospitals, domestic use etc. A display and other elements of a computer mounted in the desk are secure and protected when the console is closed, while being easily accessible by opening the console for use. By locking the console in the closed position, extra security can be obtained for the computer elements.

The console is not limited to use as a computer console, but can be used without a computer to provide a secured, accessible recess, which, when the console is open, still affords the whole area of the console surface to work on.

The invention provides an advantage over the prior art in that the first member or keyboard tray provides a usable working surface in addition to the surrounding console top. In addition, the keyboard or other input device can remain on the first member or keyboard tray both when the second member or lid is deployed and when the second member or lid is closed.

Additionally, the footprint of a console according to the invention can be small, because working area is not lost when the lid is raised. The console can therefore be smaller than would otherwise be possible.

The size of the console is determined by the size of a display unit, if any, mounted on the lid, and the size of any other elements of a computer that are to be used with the console. The height of the console can also be altered depending upon requirements.

Preferably, the lid is pivotable while the keyboard tray is fixed in position. This has the advantage that adjustment of the display is possible, while the keyboard tray remains fixed in a usable position.

BRIEF DESCRIPTION OF THE DRAWINGS

The invention will now be described, purely by way of example, with reference to the accompanying drawings in which.

DETAILED DESCRIPTION OF PREFERRED EMBODIMENT

Figure 1:
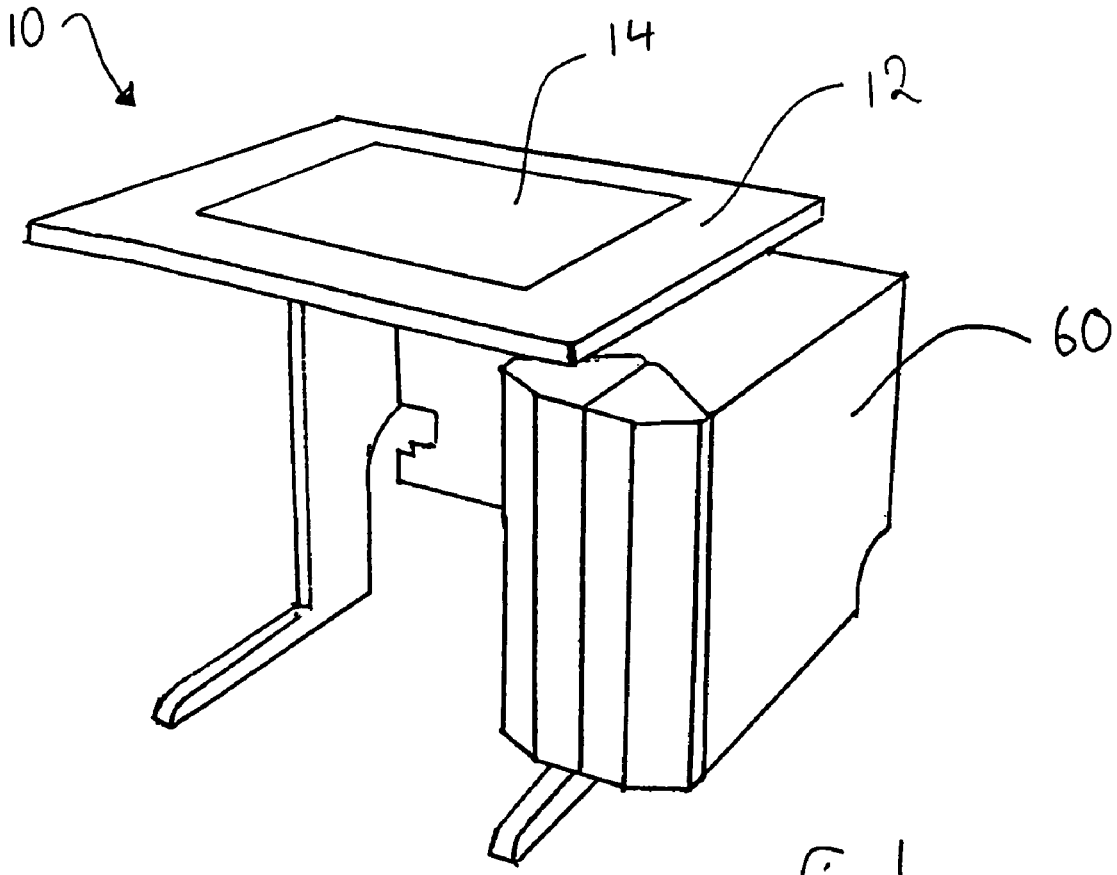
FIG. 1 shows a perspective view of a desk or console according to a first embodiment of the present invention in a closed position and first configuration.

FIG. 1 shows a closed or first position of a console 10 according to a first embodiment of the invention. The console 10 has a front, at which a user can sit. The console 10 is, in this embodiment, a desk and comprises a console top 12 on the top of the console 10 and a flat lid 14, which closes, and preferably defines the edges of, a cut out portion or opening in the console top 12 and is preferably substantially in register with it when in the closed position. In this way, the upper surface of the console top 12 and the upper surface of the lid 14 form a substantially continuous flat surface.

The edges of the lid 14 are bevelled. This prevents a shearing action acting on any objects placed between the console top 12 and lid 14. The edges of the opening in the console top 12 may also be bevelled at a complimentary angle to that of the lid 14. Alternatively, no bevelling of either console top 12 or lid 14 may be present.

Figure 2:
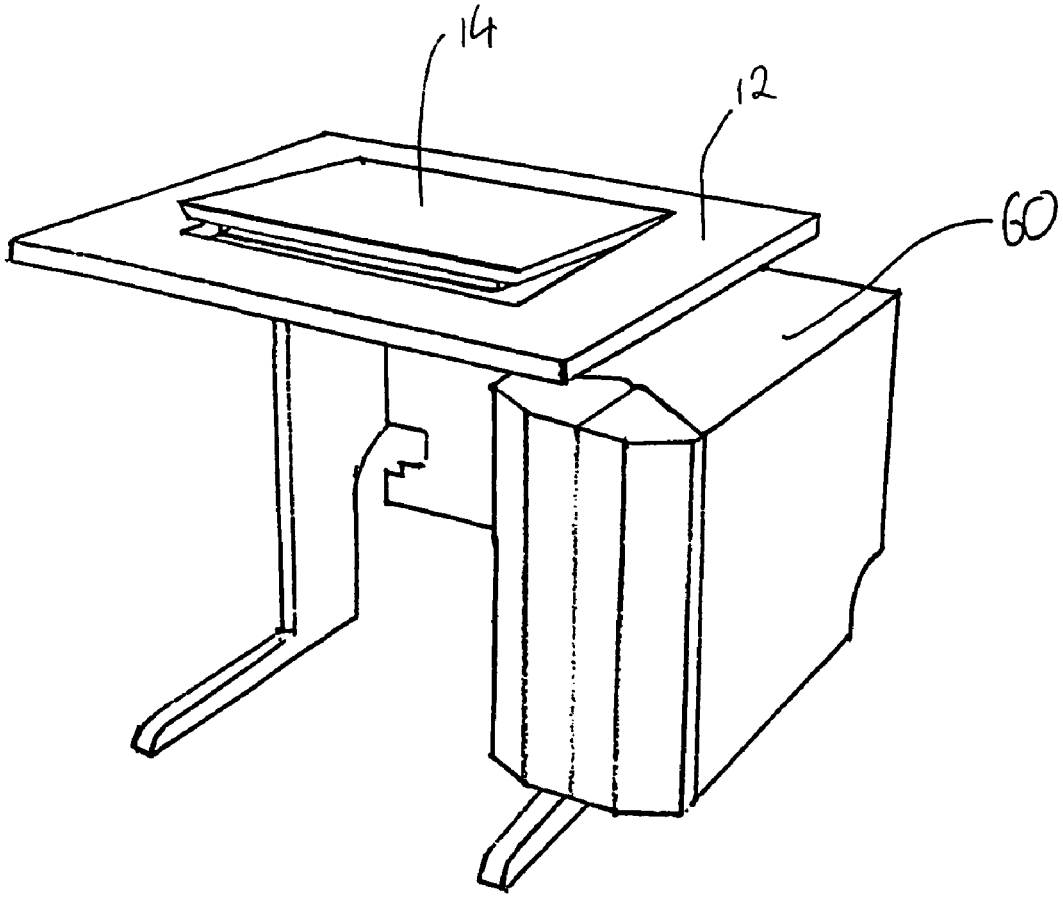
FIG. 2 shows a perspective view of a desk or console according to the first embodiment of the present invention in a partially open position.
Figure 3:
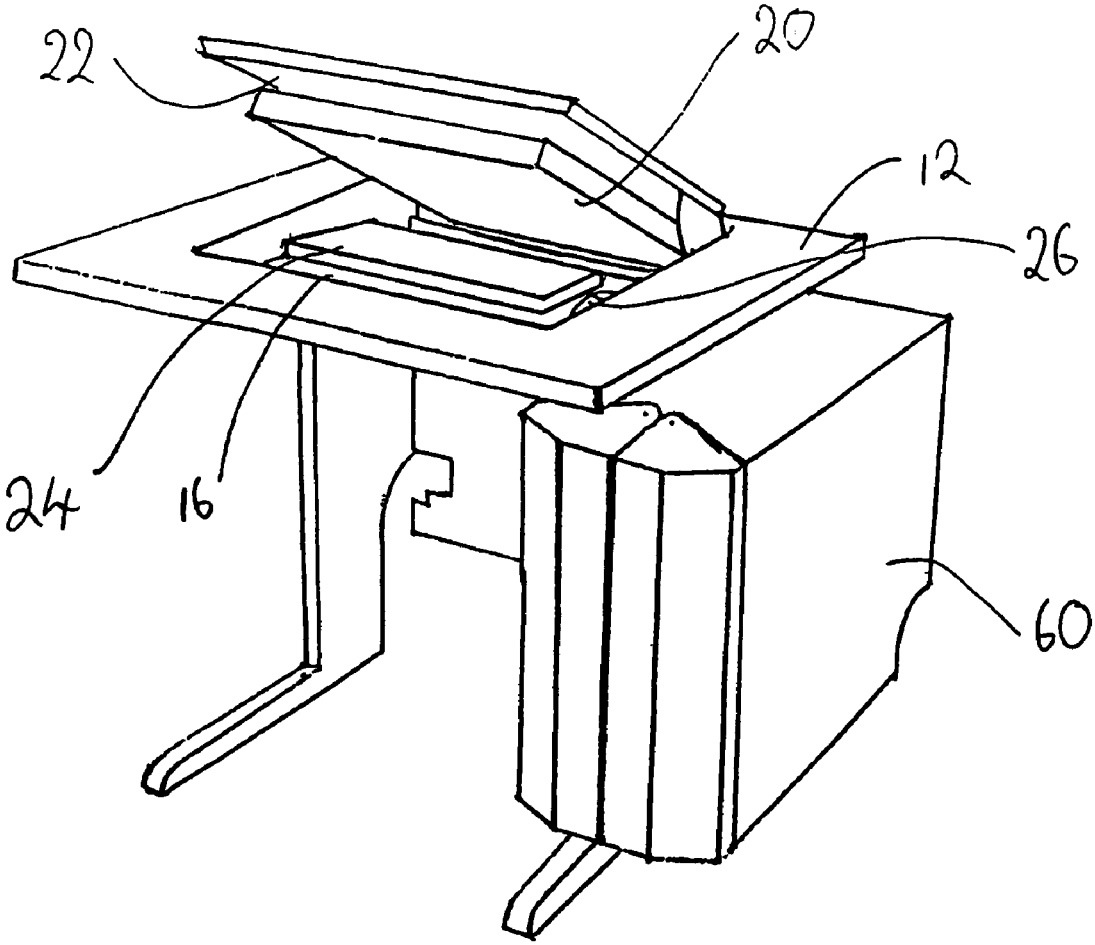
FIG. 3 shows a perspective view of a desk or console according to the first embodiment of the present invention in a further partially open position.

FIGS. 2 and 3 show the opening of the console 10 of the first embodiment. A monitor 20 is mounted on the lower surface 22 of the lid 14. The monitor 20 is a flat screen monitor 20, e.g., an LCD monitor, although any suitable display device may be mounted on the lid 14, One or more speakers may also be mounted on the lower surface 22 of the lid 14. A keyboard tray 16 rises up from a stowed position. Instead of a display 20 mounted to the lid 14, a laptop computer could be placed or mounted on the keyboard tray 16.

In the closed configuration, the keyboard tray 16 is stowed in a recess 18 underneath the lid 14, inside the console 10 in a stowed position, The keyboard tray 16 has a flat upper surface. A keyboard 24 and a mouse 26 can be positioned on the flat upper surface of the keyboard tray 16. The keyboard tray 16 has a raised rear portion, to prevent objects from falling off the keyboard tray 16 and into the recess 18. A hole is also provided at the rear of the keyboard tray 16, through which any wires from keyboard 24 and/or mouse 26 may be fed. Once again, however, any suitable input device(s) may be used.

The keyboard 24 may be fixed to the keyboard tray 16, or may be freely movable on the keyboard tray 16 and console top 12.

Figure 4:
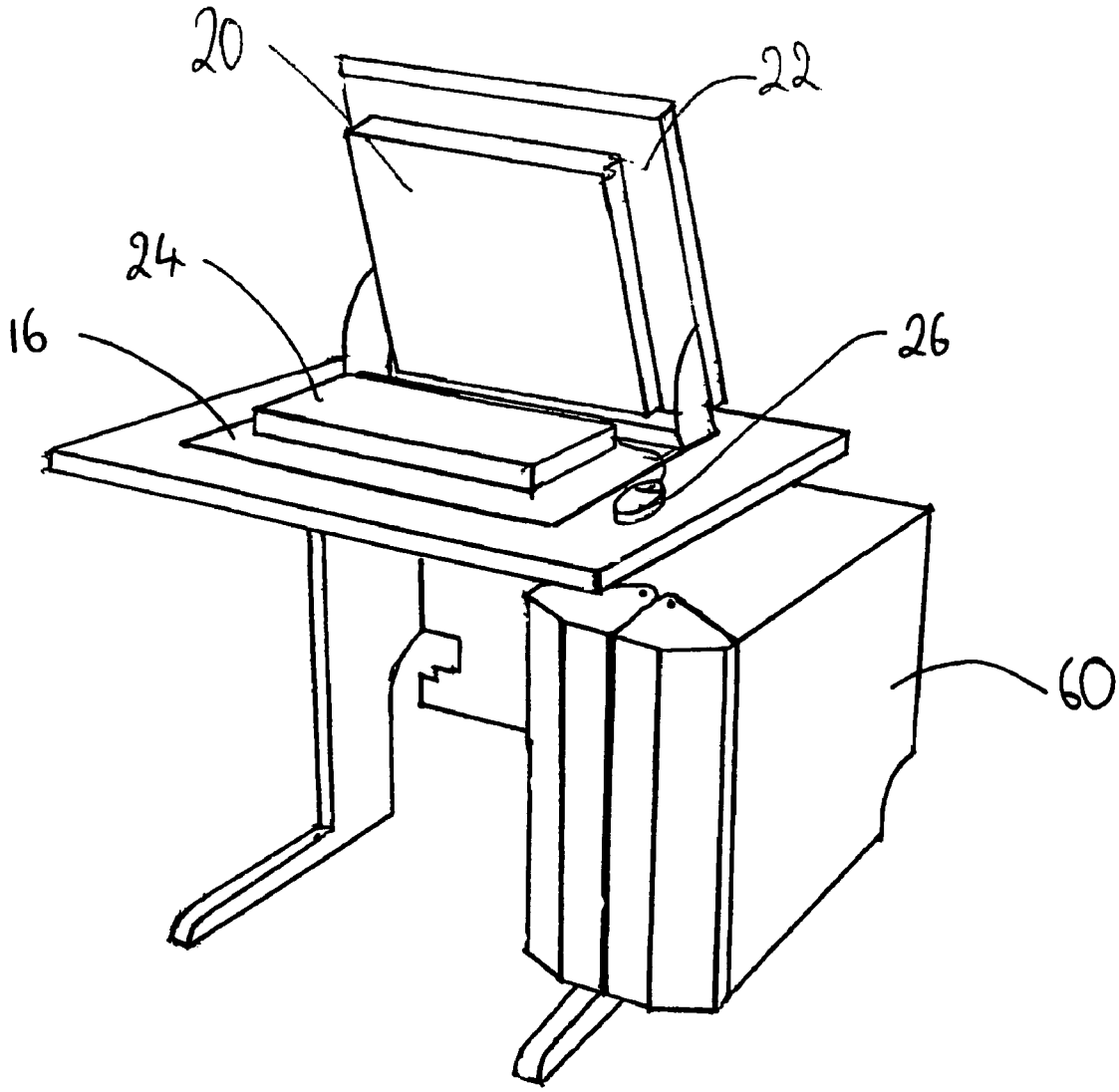
FIG. 4 shows a perspective view of a desk or console according to the first embodiment of the present invention in a fully open position and second configuration.
Figure 5:
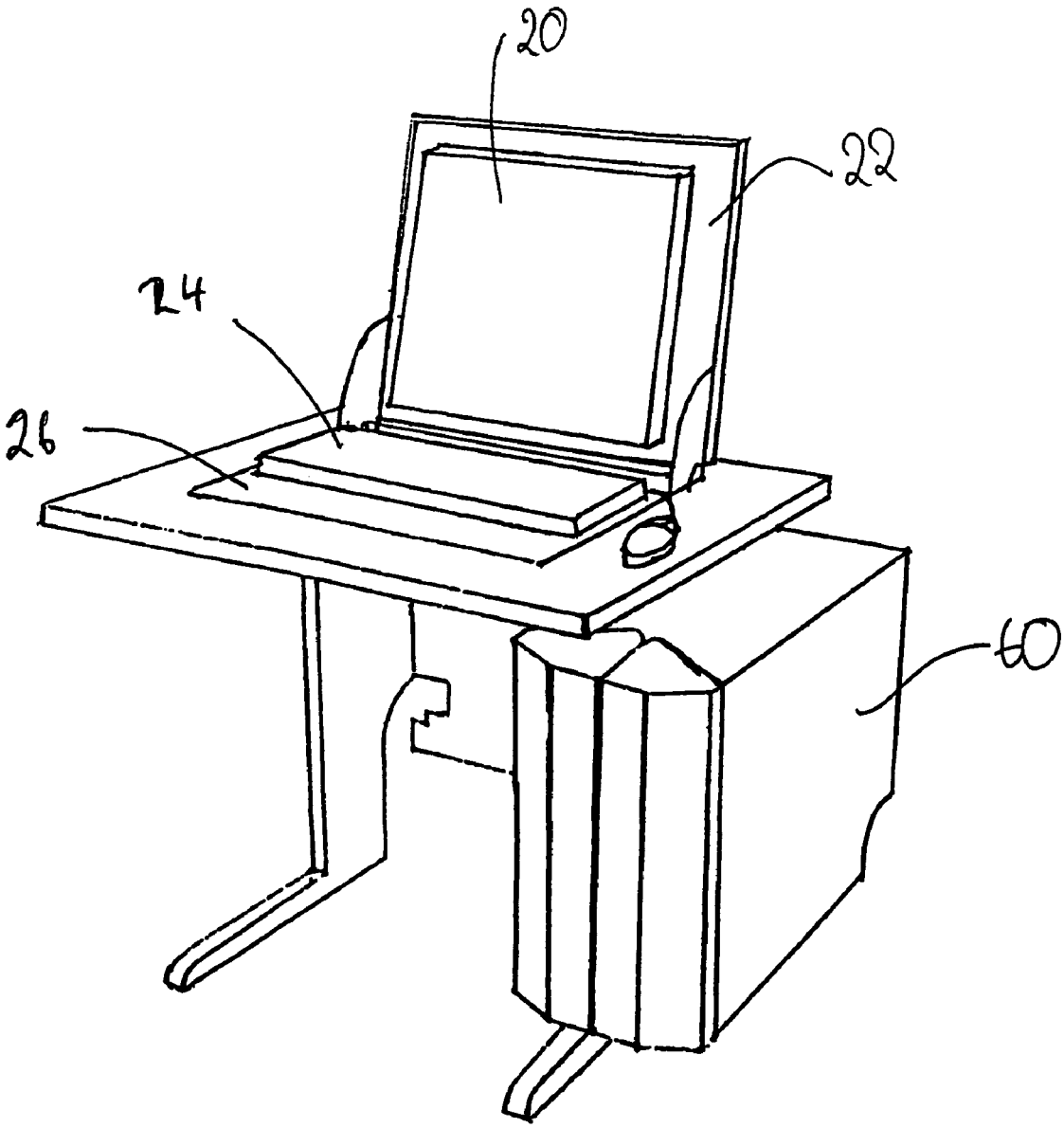
FIG. 5 shows a perspective view of a desk or console according to the first embodiment of the present invention in a further fully open position and second configuration.

FIG. 4 shows the console 10 of the first embodiment in an open position. The lid 14 is deployed such that the monitor 20 is visible to a user of the console 10. The keyboard tray 16 is secured in the working, position so that it is mechanically prevented from returning into the recess 18 (as described below), FIG. 5 shows the console 10 of the first embodiment in an alternative open position.

Once the console 10 has reached the open position of FIG. 4, the lid 14 can be tilted between the position shown in FIG. 4 and the one shown in FIG. 5 (as described below). This allows adjustment of the viewing angle of the display without affecting the position of the keyboard tray 16.

Figure 6A:
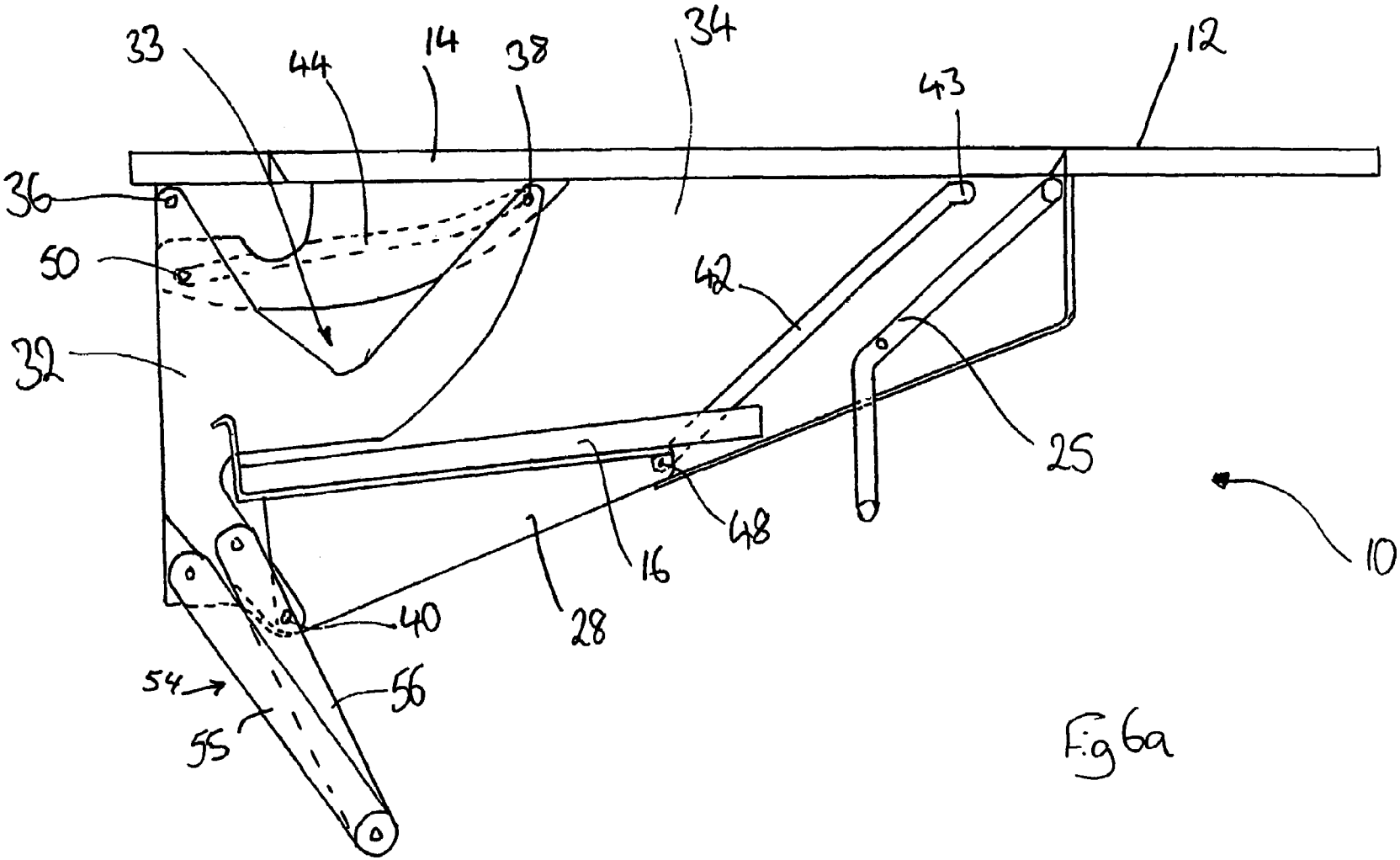
FIG. 6*a* shows a detail through a desk or console according to a first embodiment of the present invention in a closed position and first configuration.

FIGS. 6*a* to 6*f* show sections through a console 10 according to the first embodiment in different stages of opening. FIG. 6*a* shows a section through the console 10 when in the closed or first position.

The features of the embodiment described below are mirrored on the other side of the console 10 such that the lid and keyboard tray 14, 16 are coupled and mounted in the same manner on each side of the console 10.

Figure 6B:
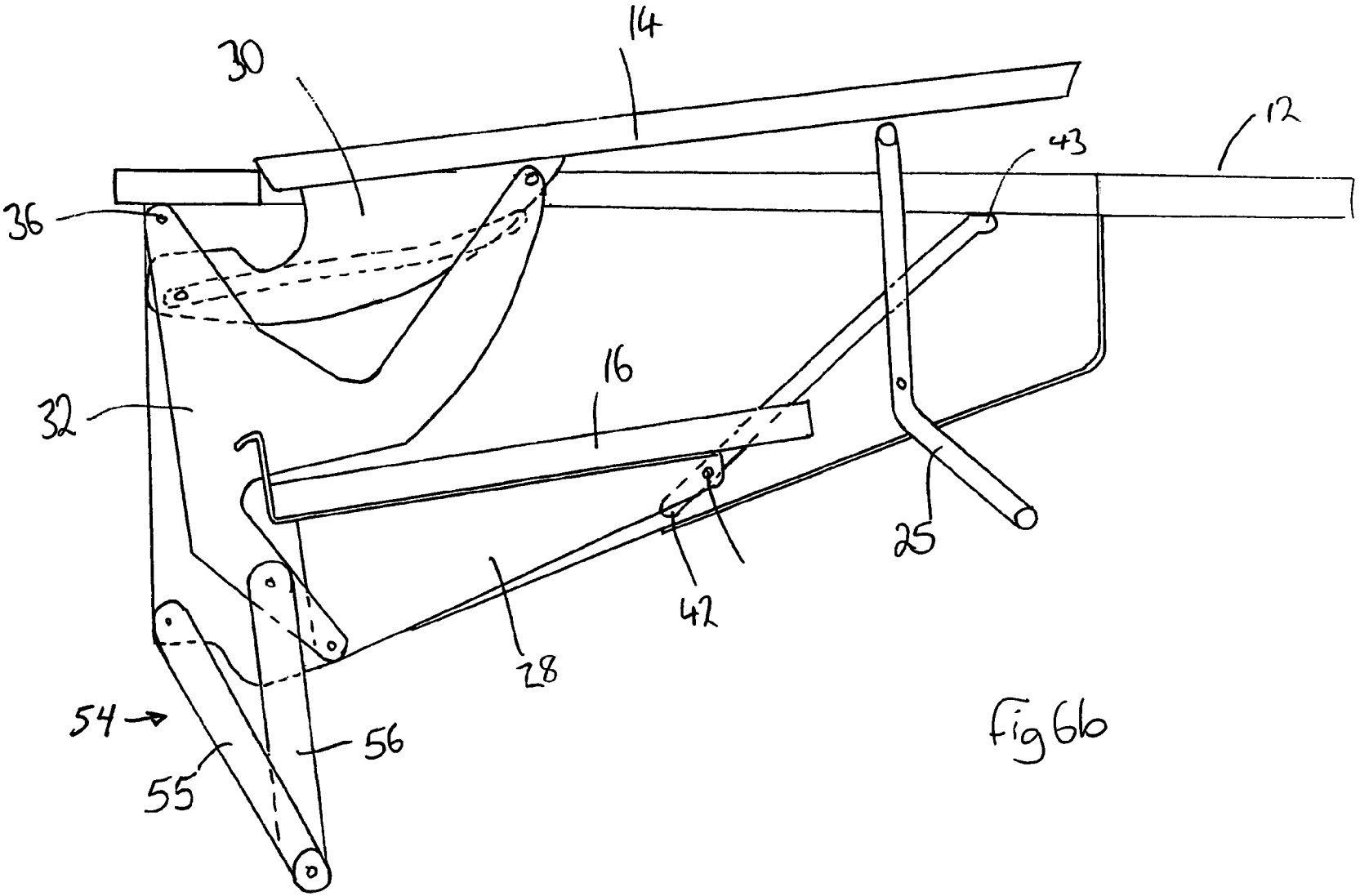
FIG. 6*b* shows a view of a desk or console according to the first embodiment of the present invention in a partially open position.
Figure 6C:
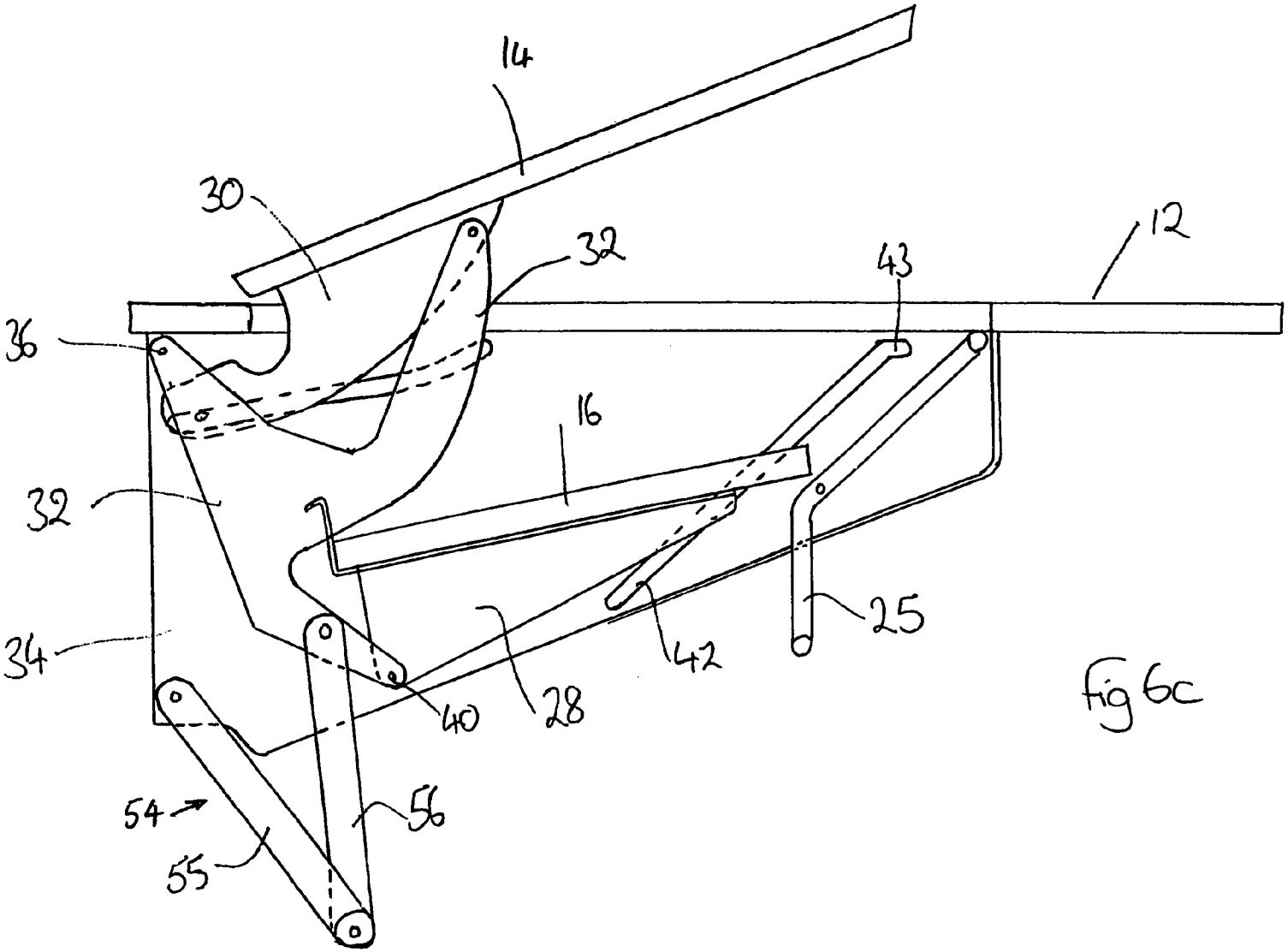
FIG. 6*c* shows a view of a desk or console according to the first embodiment of the present invention in a further partially open position.
Figure 6D:
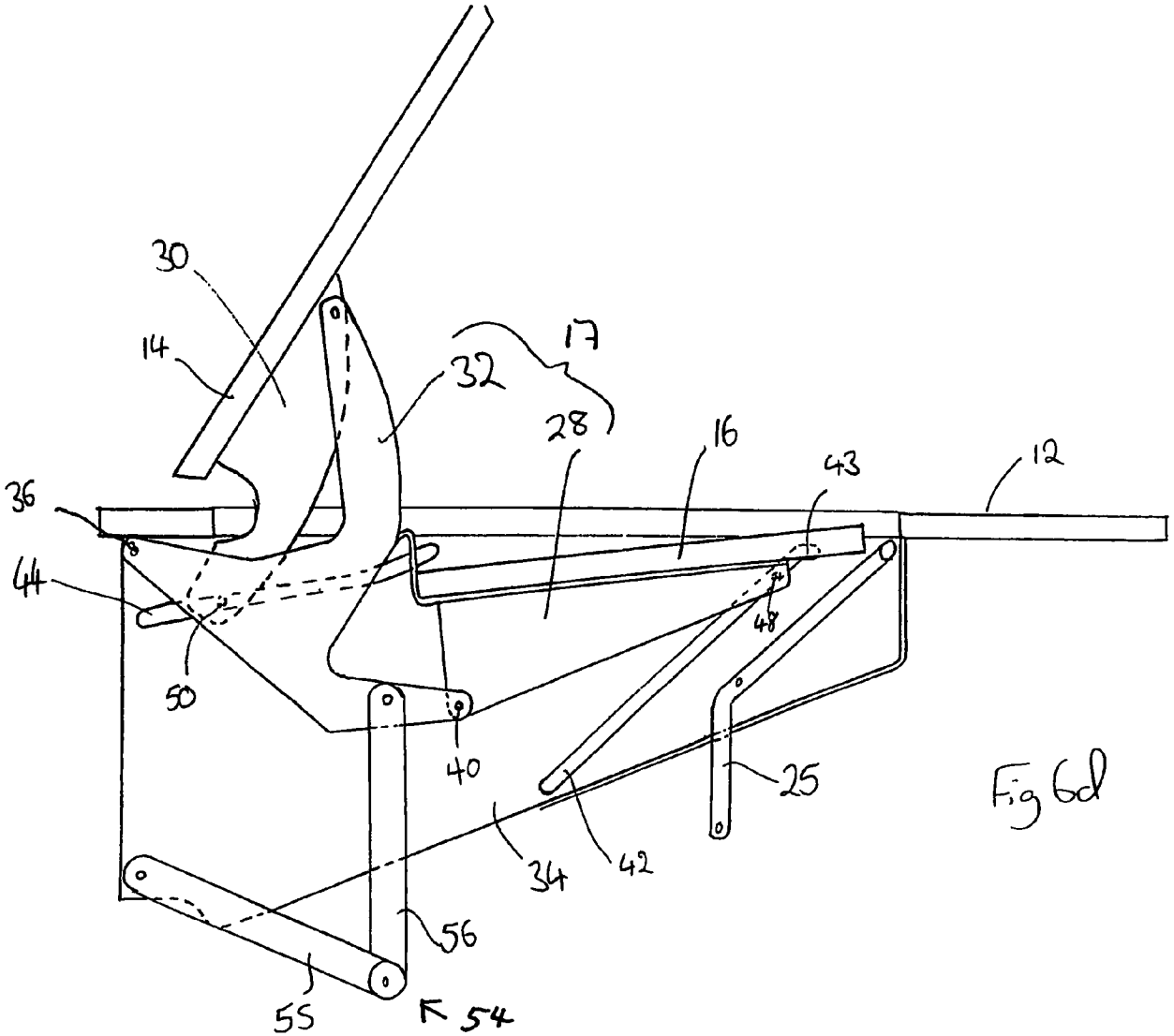
FIG. 6*d* shows a view of a desk or console according to the first embodiment of the present invention in a further partially open position.
Figure 6E:
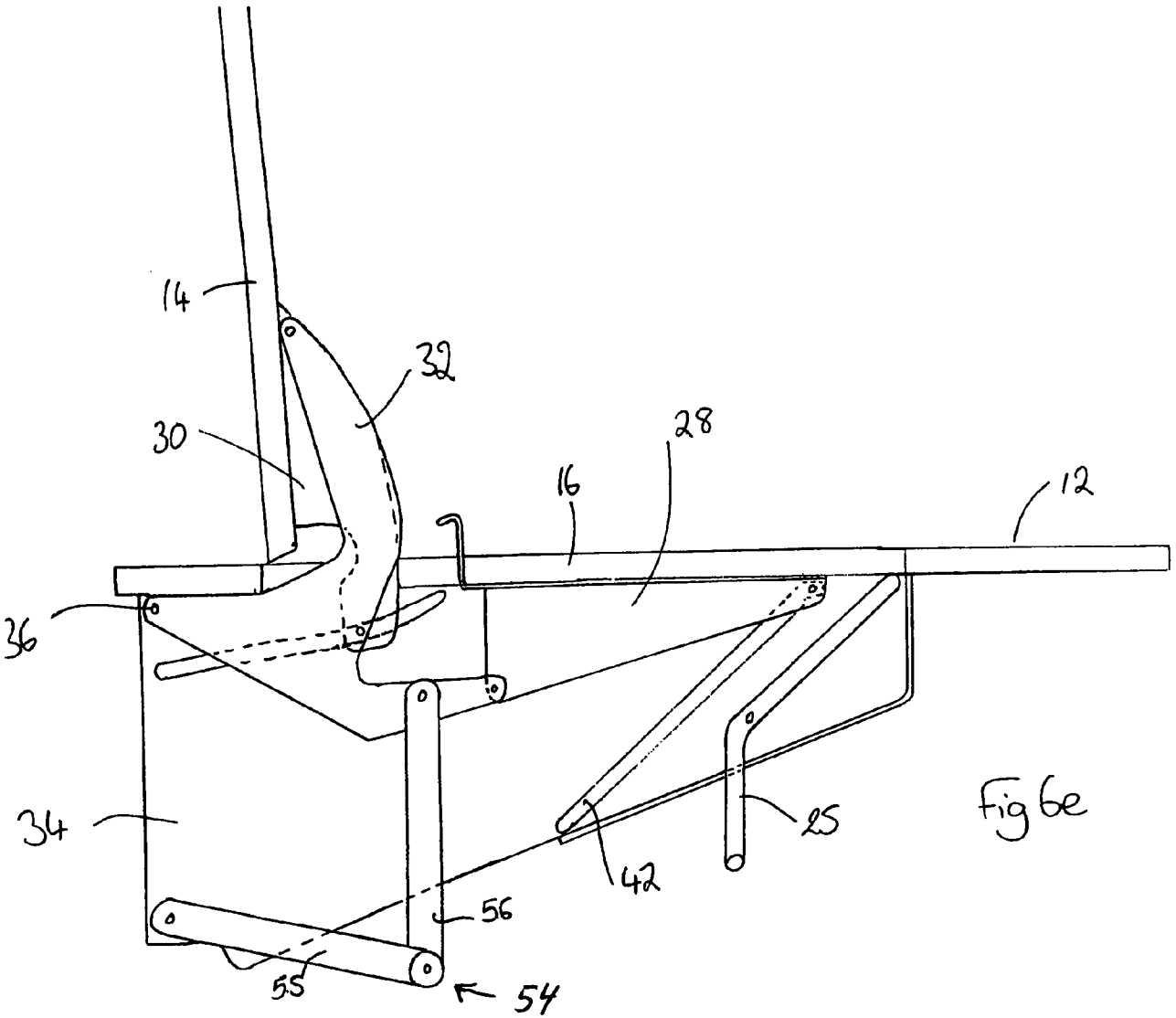
FIG. 6*e* shows a view of a desk or console according to the first embodiment of the present invention in an open position.
Figure 6F:
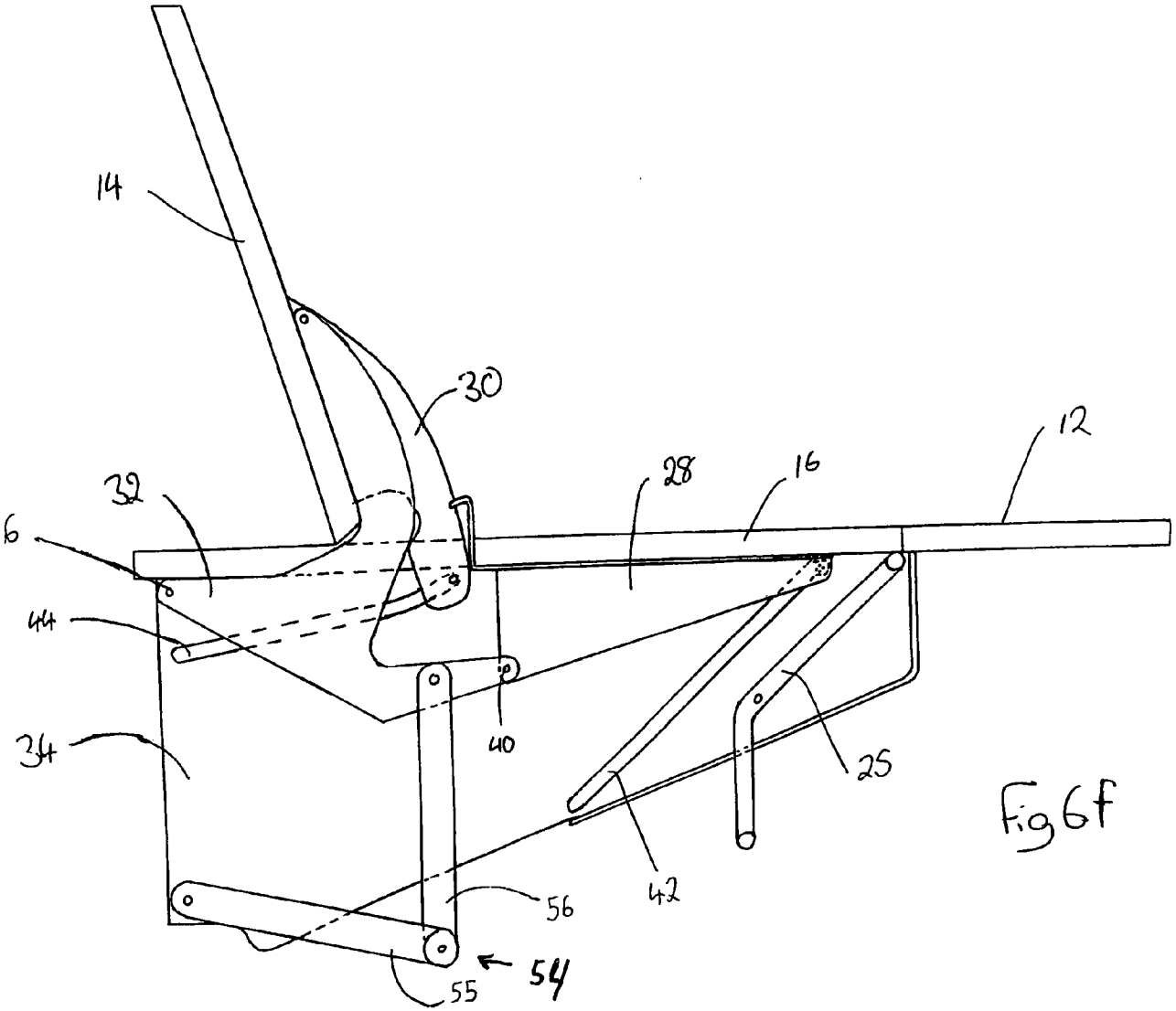
FIG. 6*f* shows a view of a desk or console according to the first embodiment of the present invention in a further open position.

As shown in FIG. 6, the lid and keyboard tray 14, 16 are coupled at the side by a mechanism 17 which is movable between a closed or first configuration as shown in FIG. 6*a* and an open or second configuration as shown in FIGS. 6*e* and. 6*f*, through steps shown in FIGS. 6*b*, 6*e* and 6*d*.

The lid 14 is initially opened from the closed position shown in FIG. 6*a* by pulling forward a lid opening mechanism 25. On pulling the lid opening mechanism 25 forward towards a user, the lid 14 rises up sufficiently for the user to grasp it, for example the lid 14 may rise by approximately 5°. This initial rising occurs because the lid opening mechanism 25 pivots on the pivot point 27 and the top of the lid opening mechanism 25 rotates rearwardly, so pushing the lid 14 upwards as shown in FIG. 6*b*.

The lid 14 is then lifted by a user at the front of the console 10 from the console top 12.

As the lid 14 is lifted, the keyboard tray 16 moves upwardly towards the deployed position. As it does so, it pushes the top of the lid opening mechanism 25 forwards, so returning the lid opening mechanism 25 to its default position.

Alternatively, the lid 14 may be retained in the closed position by use of latch (not shown), which may be key operated, mounted under the console top 12, engaging the lid 14. As a further alternative, the latch between the console top 12 and lid 14 may be operated by operation of a recessed lever on the upper surface of console top 12. As a further alternative, the latching mechanism may be a power electro-mechanical lock; controlled either locally or remotely.

As shown in FIG. 6, the keyboard tray 16 is rigidly mounted on one side on a first bracket 28.

Similarly, the lid 14 is rigidly mounted on a second bracket 30. A connecting member 32 couples the first and second brackets 28, 30. The first bracket 28 and connecting member 32 jointly form the mechanism 17.

The connecting member 32 is generally planar and has three apexes arranged in a triangular configuration. Between the first and third apexes is a cutout portion 33. Between the second and third apexes there is another cut out portion 35.

The first apex of the connecting member 32 is pivotably mounted on a mounting bracket 34 placed to the side of the first and second members 16, 14 by a first pivot 36 such that the connecting member 32, and the rest of the mechanism 17, pivots on the first pivot 36 when the mechanism 17 moves between the closed and open configurations (as described below). The first pivot 36 may have a rotation spring attached to provide the spring loading between the console 10 and the lid 14, to effect the initial opening of the lid 14 once the catch is released.

The second apex of the connecting member 32 is pivotably coupled to the second bracket 30 by a second pivot 38. The second bracket 30, and therefore the lid 14, pivots about the second pivot 38 so as to tilt the lid 14 when the mechanism 17 is in the open configuration.

The third apex of the connecting member 32 is pivotably coupled to the first bracket 28 by a third pivot 40.

The mounting bracket 34 comprises a first guide track 42 and a second guide track 44.

The first guide track 42 runs downwardly and rearwardly.

The second guide track 44 runs generally horizontally in the mounting bracket 34.

The second guide track 44 comprises a first portion and a generally arcuate second portion forming a part circumference of a circle. The centre of this circle defines a pivot point.

A first guide pin 48 is attached to the first bracket 28 and runs in, the first guide track 42.

A second guide pin 50 is connected to the second bracket 30 and runs in the second guide track 44.

The method of operation of the console 10 will now be described starting from the closed position.

The lid 14 is lifted from its initial opening position by pulling the lid opening mechanism 25. Further movement of the lid 14 occurs by raising the lid 14 by hand. The lid 14, because it is attached to the second bracket 30 by the second pivot 38, rotates the connecting member 32 about the first pivot 36 and, because the first bracket 28 is connected to the connecting member 32, moves the first bracket 28 upwards. The front of the first bracket 28 is constrained by the positioning of the first guide pin 48 in the first track 42 to move upwardly in a predetermined manner.

The second guide pin 50 moves along the second guide track 44 during the rotation of the connecting member 32 about the first pivot 36. The second guide pin 50 moves along the first portion of the second guide track 44 during rotation about the first pivot 36.

As the lid 14 is moved upward further, the rotation of the connecting member 32 pushes the first bracket 28 to the top of the first guide track 42. The first guide track 42 is arranged such that it has a forwardly facing horizontal top part 43, into which, the first guide pin 48 on the first bracket 28 slides. This ensures that the front of the first bracket 28 does not move down the first guide track 42 through purely vertical forces, and therefore allows the keyboard tray 16 to bear weight without the mechanism 17 returning towards the closed configuration.

Once the first bracket 28 is at the top of the first guide track 42, the mechanism 17 is in the open configuration and the nature of the movement, during continued lifting of the lid 14, changes. Rotation of the second bracket 30 and connecting member 32 about the first pivot 36 while moving of the mechanism 17 to the open configuration allows the second guide pin 50 to move along the first portion of the second guide track 44, as described above. As the first bracket 28 reaches the top of the first track 42 and the mechanism 17 reaches the open configuration, the connecting member 32 can no longer rotate about the first pivot 36.

The second guide pin 50 then follows the path of the second portion of the second guide track 44. The lid 14 can therefore be moved further once the mechanism 17 is in the open configuration because the location of the second pivot 38 then coincides with the centre of the part circle defining the second portion of the second track 44. Therefore, the second bracket 30 begins to pivot about the second pivot 38 rather than the first pivot 36. This allows the lid 14 to pivot on the second pivot 38, while retaining the mechanism 17 in the open configuration. Therefore, the monitor 20 angle, relative to the user, can be altered while the keyboard tray 16 remains locked.

The movement of the second guide pin 50 from the first portion to the second portion of the second guide track 44 also aids locking of the mechanism, 17 in the open configuration. The movement of the second guide pin 50 from the first portion to the second portion has the result that the second bracket 30 can no longer rotate about the first pivot 36 because the forward part of the second track 44 follows a part circumference centered on the second pivot 38. The second guide pin 50 exerts a force on the lower side of the second guide track 44. In the second part of the third guide track 44, no rotation about the first pivot 36 is possible. Therefore, only rotation about the second pivot 38 is possible and the mechanism 17 remains locked in the open configuration.

The maximum deployment of the lid 14 away from its closed position occurs when the edge of the first cut out area 33 of the connecting member 32 abuts the lid 14. When this occurs, the lid 14 preferably does not overhang the rear of the console 10. In this case, two such consoles can be placed directly back-to-back.

The closing of the console 10 occurs in the reverse order to the opening.

The lid 14 is pulled forward by the user until the second bracket 30 has rotated sufficiently such that the second guide pin 50 has moved along the second guide track 44 from the second portion to the first portion, in which rotation about the first pivot 36 is possible.

The connecting member 32 then rotates, moving the third pivot 40 downwardly. This causes the rear of the first bracket 28 to move downwards which pulls the front of the first bracket 28 rearward, the first guide pin 48 moving rearwardly from the horizontal part 43 of the first guide track 42 and downwardly along the first guide track 42.

A damping mechanism 54 is provided on the console 10. The damping mechanism 54 slows the speed at which the lid 14 falls back from the open position to the closed position. Damping arms 55, 56 are provided to achieve this.

The damping arms 55, 56 are attached to each other at a respective end. The other end of the first damping arm 55 is attached to the mounting bracket 34. The other end of the second damping arm 56 is attached to the connecting member 32. The two damping arms 55, 56 are attached to each other via a friction washer (not shown).

The friction washer resists relative rotation of the arms 55, 56 in one direction only, corresponding to the movement of the arms during closing of the lid 14. During opening of the lid 14, the friction washer allows free movement of the lid 14. This friction limits the speed at which the lid 14 lowers as it closes. The speed restriction prevents the lid 14 from slamming, and so gives a safety benefit for reducing damage to objects between the lid 14 and console top 12 as the lid 14 closes.

As shown in FIG. 6*a*, the keyboard tray 16 is stowed in the recess 18 when the lid 14 is closed. The first bracket 28 abuts a bottom plate forming the bottom of the recess when the keyboard tray 16 is in the stowed position. This supports the mechanism to prevent the lid 14 from moving down into the recess 18, i.e. below the level of the console top 12, when the lid 14 is closed and weight is put upon it.

Additionally, the connecting member 32 abuts a rear plate of the recess 18 or the back of the console 10 when the lid 14 is closed. This also provides support for the lid 14, when it is in the closed position.

As an alternative to the pivotal mounting of the lid 14 on the mechanism 17, the lid 14 may be fixed rigidly relative to the connecting member 32, in which case there is no first pivot 36 connecting the second bracket 30 with the connecting member 32. The dimensions of the connecting member 32 may be changed to increase or decrease the ratio of the distance between the first and second apexes to the distance between the second and third apexes. In this way it is possible to adjust the angle of the lid 14 relative to the console top 12, when the mechanism 17 is in the open configuration. The monitor 22 may also be pivotably mounted on the lid 14.

The movement of the mechanism 17 may be motorized, for example by a racy mounted on the connecting member 32 and a motor mounted on the console 10 respectively.

The position of the second pivot 38 is such that the second bracket 30 and lid 14 are mounted at their centre of gravity. Therefore, the lid 14 pivots neutrally about the second pivot 38 with no angular bias.

As an alternative to, or in addition to, the damping mechanism 25, the mechanism 17 may be counterbalanced, for example by a counterbalance spring, which counteracts the downward gravitational force on the lid. This stops the lid closing accidentally.

The lid 14 may, in addition to, or instead of, bevelled edges, have soft edges, for example plastic or rubber, softening any impact of the desk lid as it closes. The edge of the hole in the console top 12 may have soft edges as well as, or instead of, the lid 14.

The lid 14 may also be spring-floated. The lid 14 is then fixed onto the mechanism, 17 or second bracket 30, by spring fittings. The springs hold the lid securely to the mechanism 17 or second bracket 30 during normal use. However, the springs can allow a gap between the console top 12 and the lid 14 when the mechanism 17 is in the closed configuration, should any object obstruct the opening in the console top 12.

Figure 7:
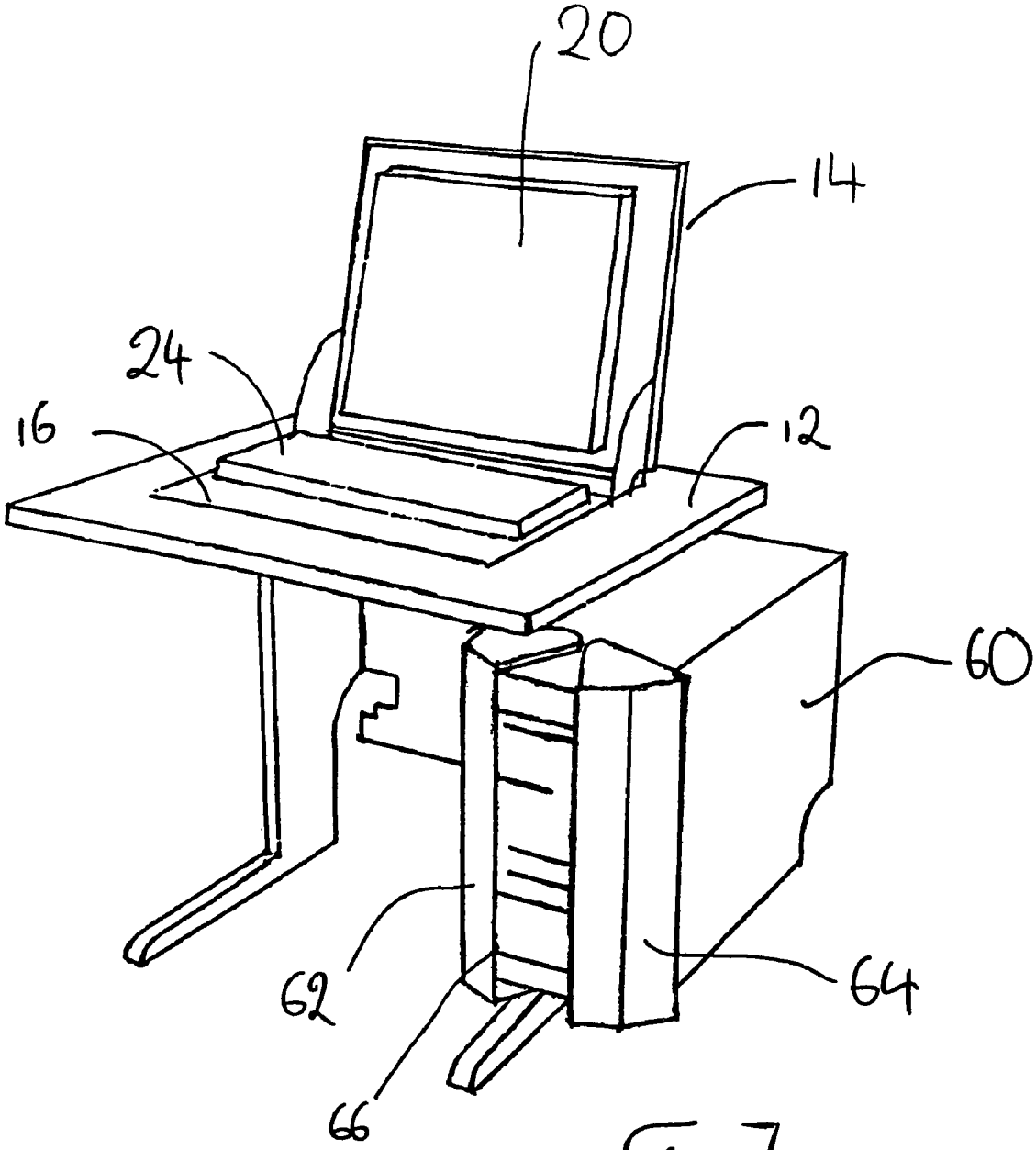
FIG. 7 shows a perspective view of a desk or console according to the first embodiment of the present invention with CPU enclosure doors partially open.
Figure 8:
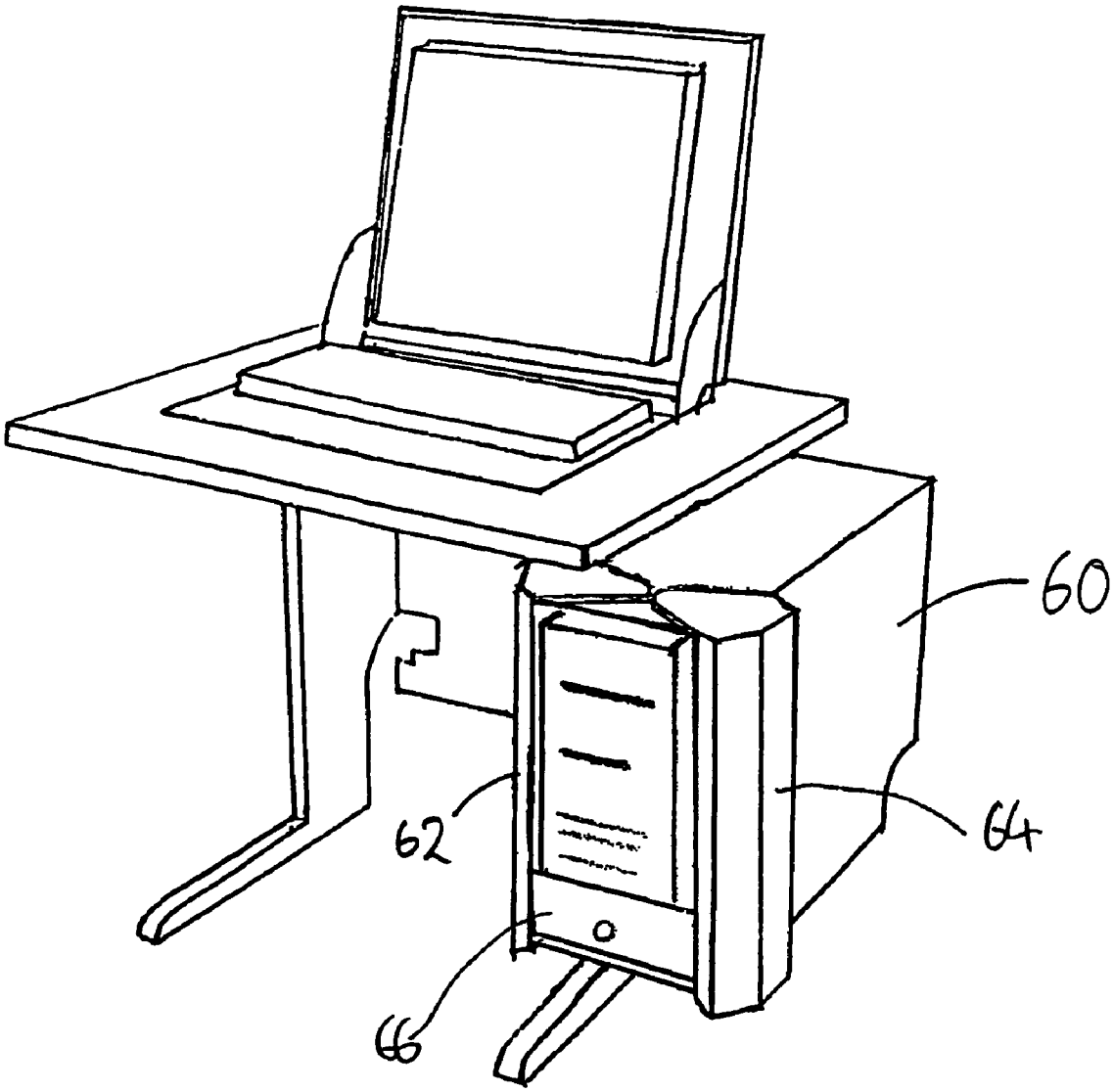
FIG. 8 shows a perspective view of a desk or console according to the first embodiment of the present invention with CPU enclosure doors fully open.

The console of the first embodiment also comprises a CPU enclosure 60. A CPU may be securely mounted in the enclosure 60. The front of the CPU enclosure comprises two doors 62, 64. The doors 62, 64 are lockable. As shown in FIGS. 7 and 8, the doors 62, 64 open to allow access to the front of a CPU housed in the CPU enclosure 60. A locking plate 66 is placed across the front of the CPU enclosure 60. The opening in the front of the CPU enclosure 60 when the plate 66 is secured in place is not large enough to allow the removal of the CPU from the enclosure 60.

Figure 9:
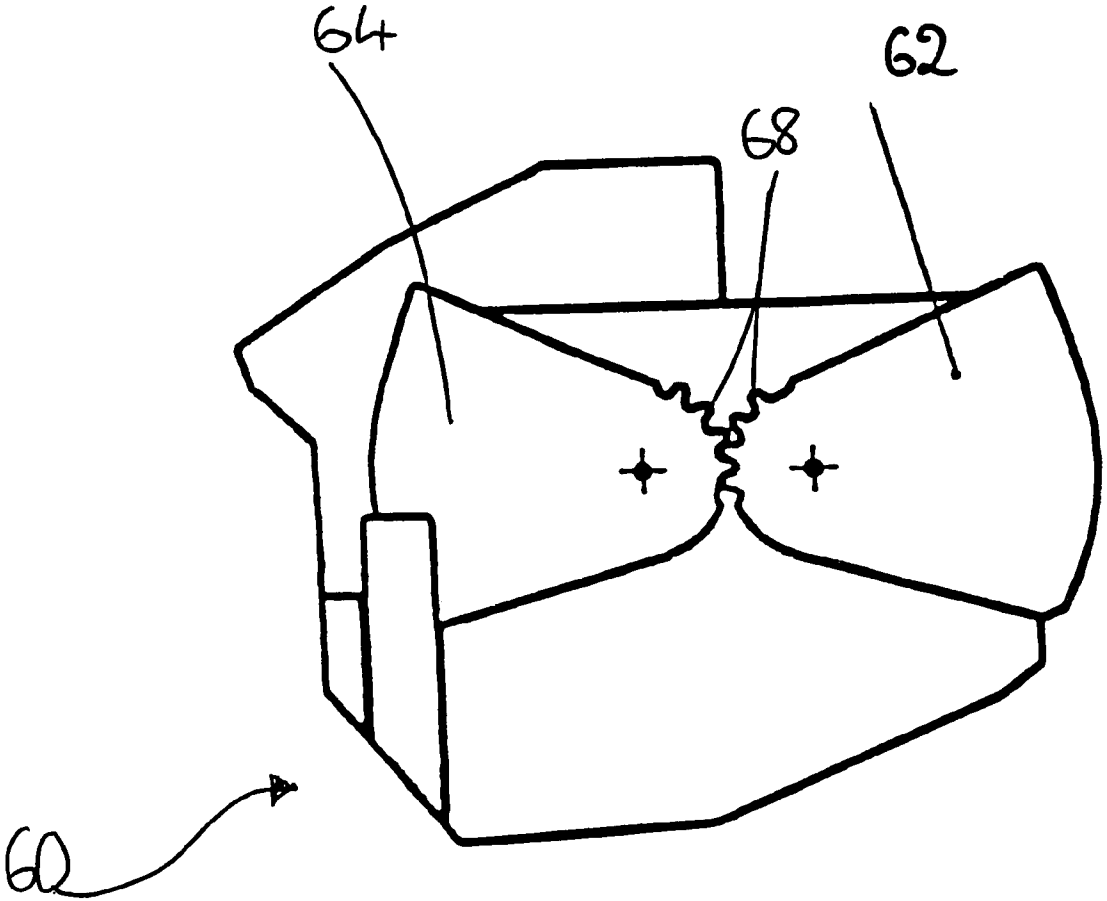
FIG. 9 shows a detail of a desk or console according to the first embodiment of the present invention.

The doors 62, 64 are pivotably mounted at the top and bottom of the enclosure 60. The doors 62, 64 each have gear teeth 68, and are geared to each other so that they counter-rotate in unison on opening, as shown in FIG. 9.

The CPU enclosure 60 also has a second compartment (not shown), underneath the compartment for the CPU. The second compartment is lockable and contains power points for the CPU and any other peripherals that may be used. The provision of the second compartment ensures that cables are kept within the console and provides neatness and safety, as the power and other cables are not exposed.

A CPU enclosure need not be provided. For example, where the computer and screen are formed in a single unit, there is no separate CPU and therefore no need for a separate CPU enclosure.

Several consoles 10 may be coupled together to form a bench or the like. Alternatively, a single console 10 may have more than one opening section, each independently operating in the manner described above.

Figure 10:
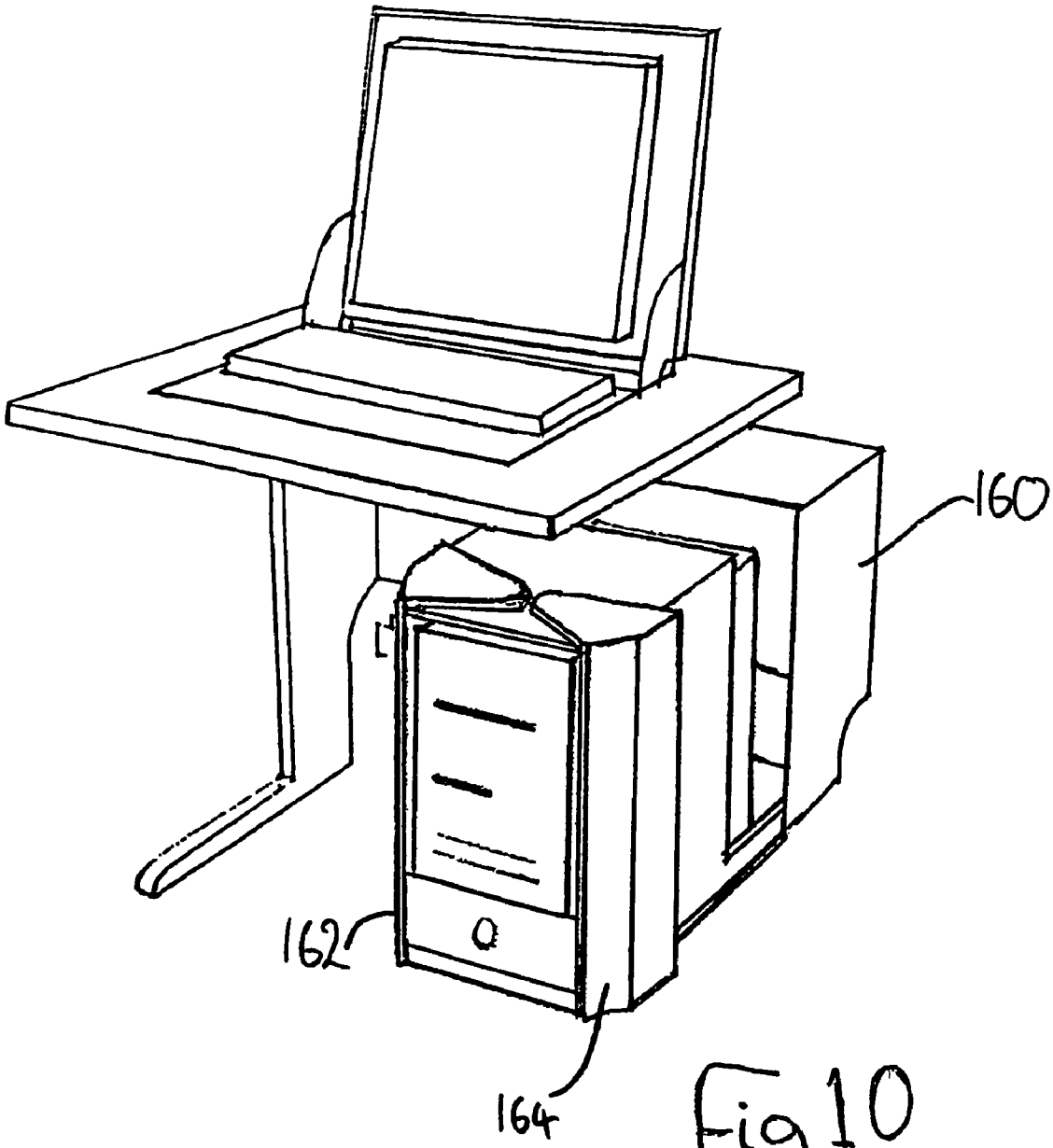
FIG. 10 shows a perspective view of a desk or console according to a second embodiment of the present invention with the CPU enclosure in a different configuration.

According to a second embodiment of the invention, as shown in FIG. 10, the CPU enclosure 160 is formed in two parts. The rear part is mounted to the desk. The front part, comprising the doors 162, 164, is mounted on the rear part so that it can slide forwards. When the front and rear parts of the CPU enclosure 160 are together, the CPU is secured within the enclosure 160, although access to the front of the CPU is possible through the doors 162, 164. The other aspects of the embodiment are as described in the first embodiment.

In order to gain access to the back of the CPU, the CPU in the enclosure 164 moves forward with the front part, exposing the rear of the CPU. The front part of the CPU enclosure 164 is mounted to the rear part by runners, which also separate when the front part is slid forwards in order to allow the front part of the enclosure 164, and therefore the CPU, to be removed.

Figure 11:
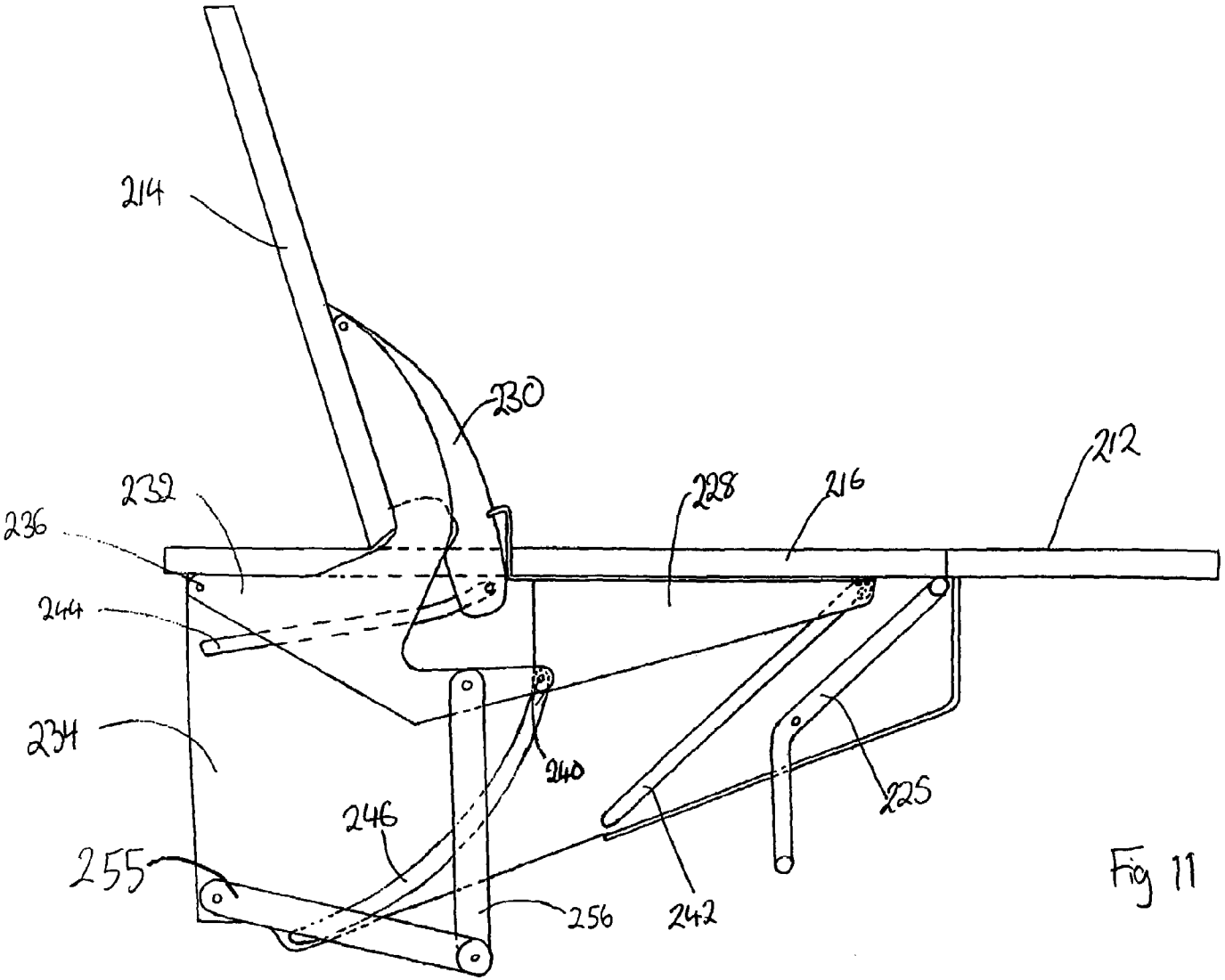
FIG. 11 shows a detail of the internal mechanism of a third embodiment of the present invention.

A third embodiment of the invention will now be described with reference to FIG. 11 of the description. The third embodiment of the invention is similar to the first embodiment. A mounting bracket 234 is mounted on each side of the console. However, the mounting brackets 234 comprise a first track 242, a second track 244 and, additionally, a third track 246.

The third guide track 246 is positioned rearward of the first guide track 242 and forms a part circumference of a circle, the centre of which is the first pivot 236 (as in the first embodiment) 236.

A third guide pin 252 is attached to the third pivot 244 which pivotably connects the connecting member 232 and the first bracket 228 as in the first embodiment, and runs in the third guide track 246. This third guide pin 252 constrains both the connecting member 232 and rear of the first bracket 228 to move in the path of the third guide track 246.

The console operation is the same as in the first embodiment. The second member 214 is lifted and this rotates the connecting member 232 about the first pivot 236.

The third guide pin 252 guides the connecting member 232 and first bracket 228 (and therefore first member 216) upwards along the third guide track 246. The movement of the third guide pin 252 upwards along the third guide track 246 forces the first guide pin 248 along the first guide track 242, so that both the front and rear of the first bracket 228 move smoothly upward.

The restriction of the third pivot 244 to move along the third guide track 246 provides additional support to the mechanism 217, and, by adding a retaining member to the third guide pin 252 on the opposite side of the mounting bracket 234 to the mechanism 217, lateral movement of the mechanism 217 away from the mounting bracket 234 can be avoided. Additionally, the lower end of the third track can be set such that the third guide pin 252 reaches the lower end of the third guide track 246 when the lid 214 is in the closed position, so providing further support against the lid 214 entering the recess.

The other aspects of the third embodiment are generally the same as those of the first embodiment.

Figure 12:
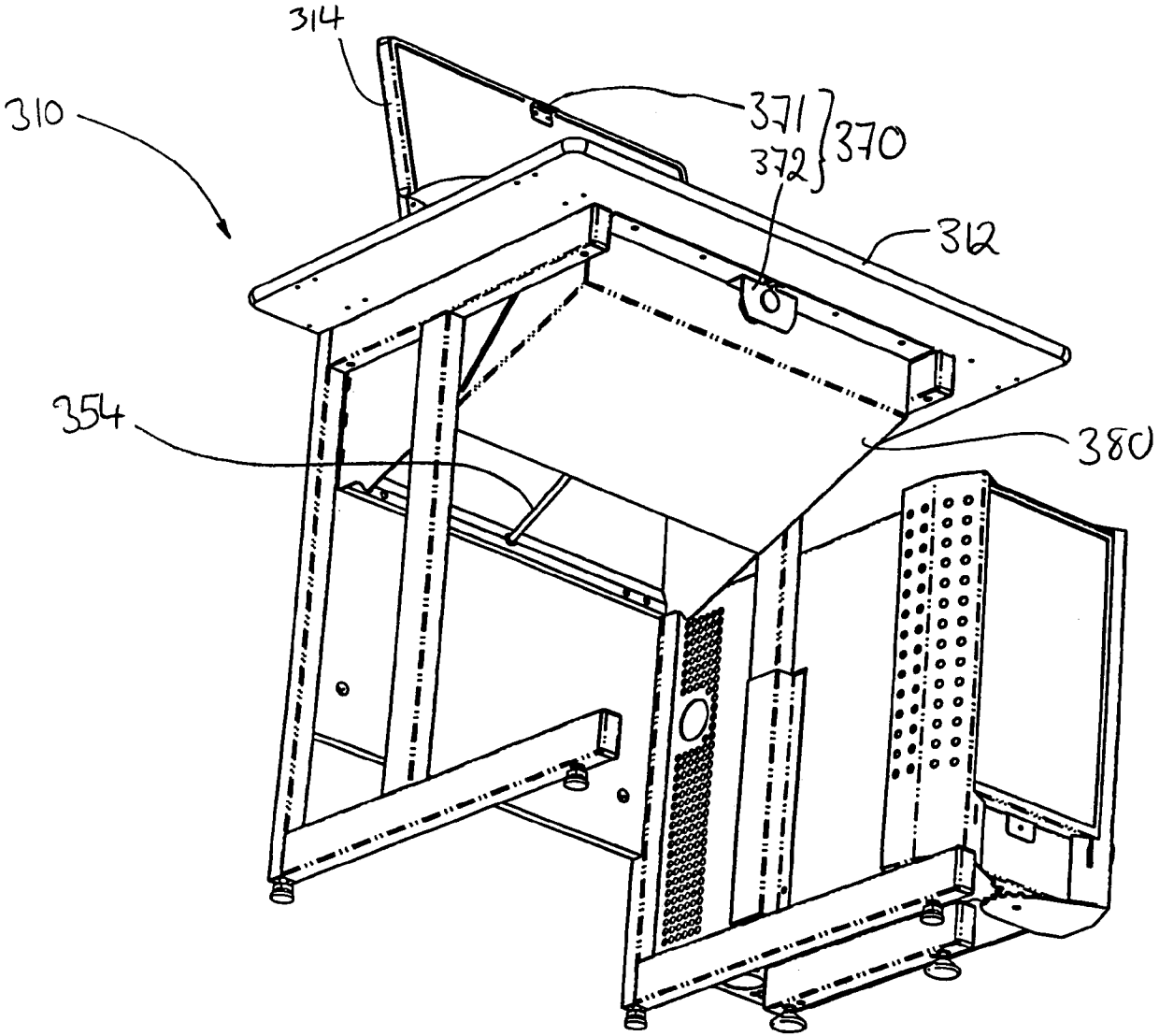
FIG. 12 shows a perspective view of a fourth embodiment of the present invention.
Figure 13:
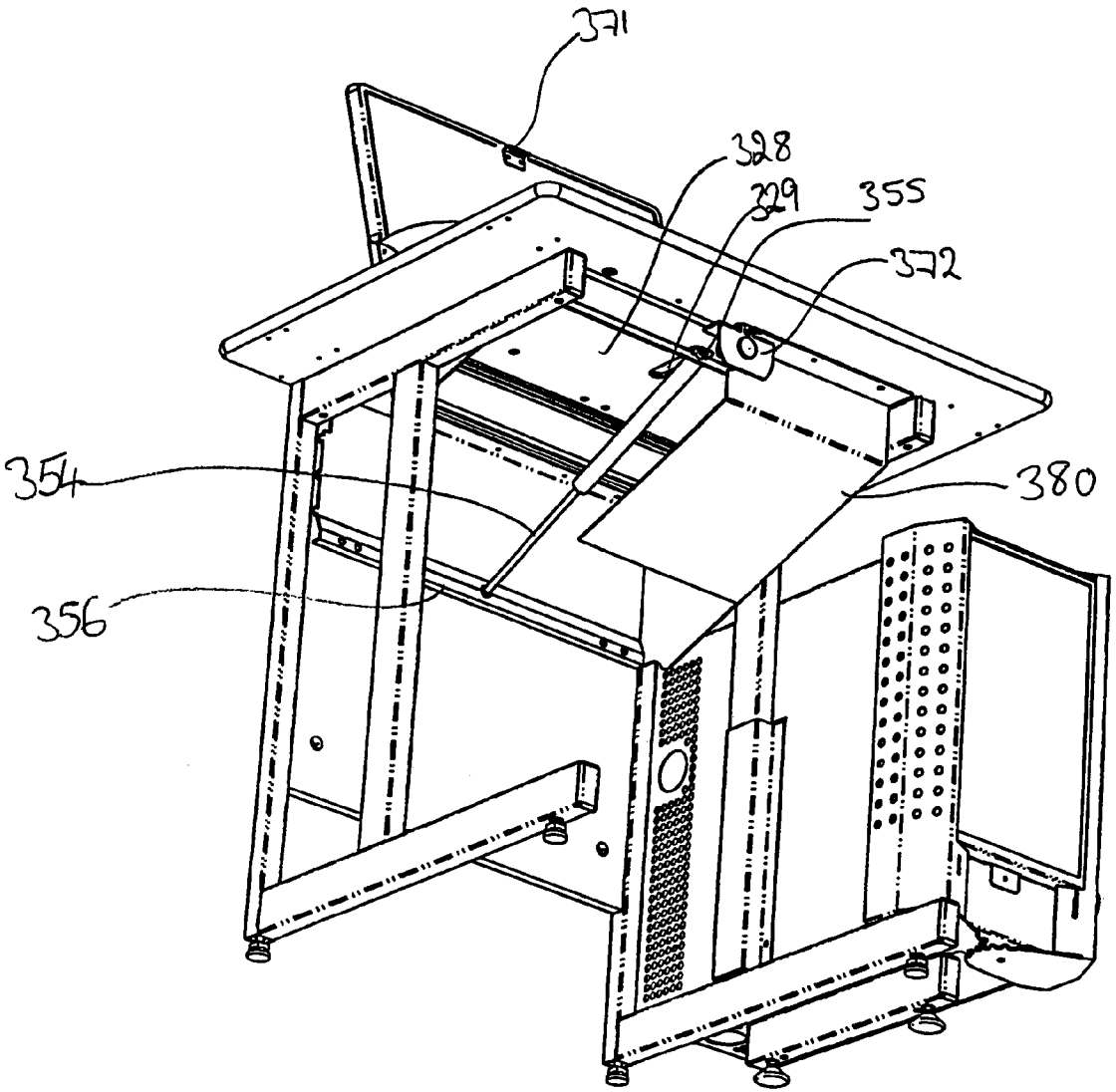
FIG. 13 shows a further perspective view of the fourth embodiment of the present invention.
Figure 14:
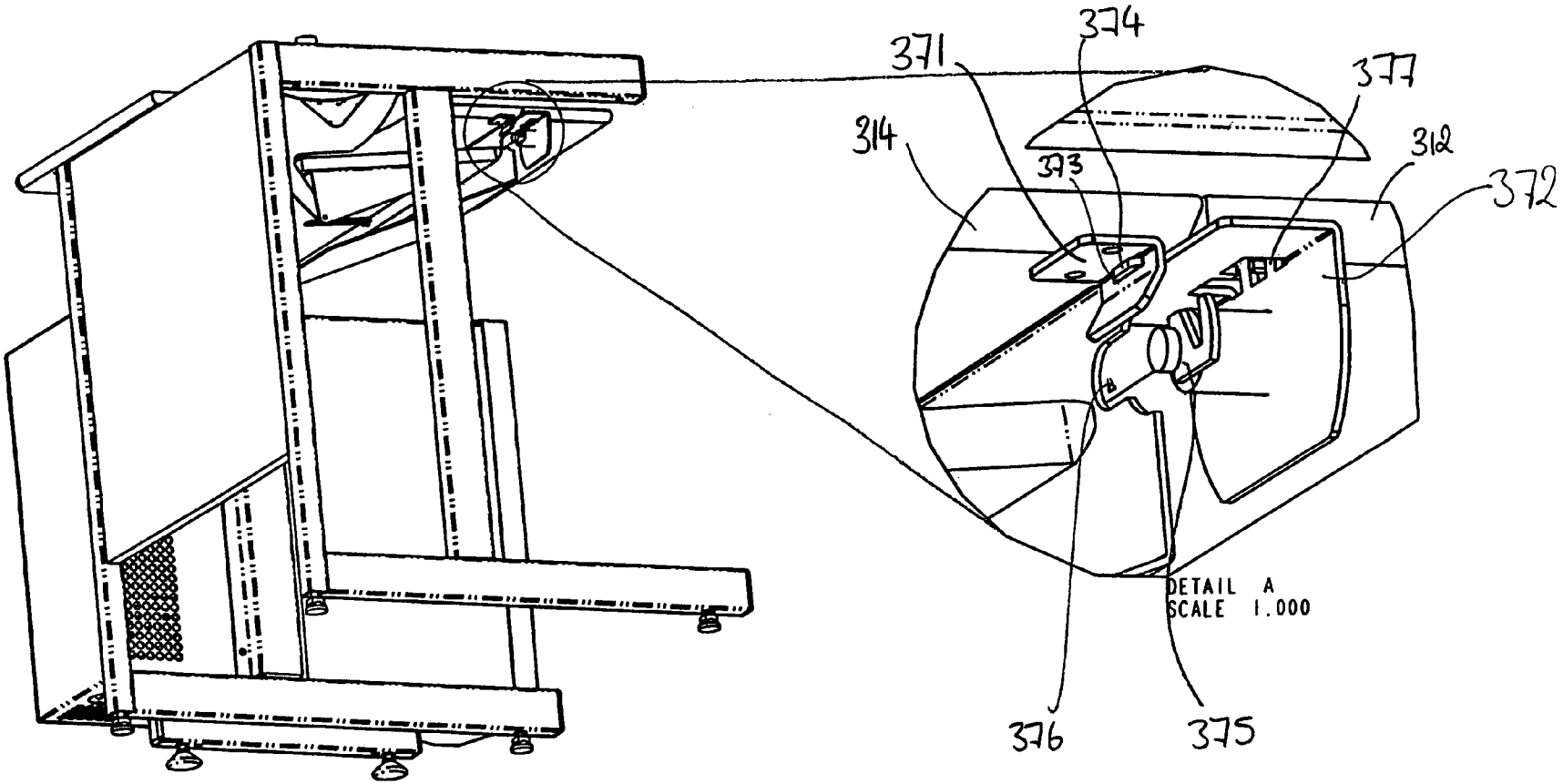
FIG. 14 shows a detail of the fourth embodiment of the present invention.

FIGS. 12, 13 and 14 show a fourth embodiment of the invention.

FIG. 12 shows an underneath perspective view of the console 310. The console 310 is similar to console 10 of the first embodiment. However, the damping mechanism of the first embodiment is replaced by pneumatic damper 354. Additionally, the lid opening mechanism 25 of the first embodiment is replaced by catch 370.

The catch 370 comprises two members. The first catch member 371 is attached to the lid 314. The second catch member 372 is coupled to the console top 312.

A casing 380 is also provided on the underside of the console top 312 so as to protect the underside of the console 310.

FIG. 13 shows a further view of the console 310 of the fourth embodiment with part of the casing 380 cut away to shove the pneumatic damper 354.

Pneumatic damper 354 is attached to a first bracket 328 towards the front of the first bracket 328. The first bracket 328 of this embodiment is similar to the first bracket 28 of the first embodiment. However, the first bracket 328 also has a cut out portion 329 to allow the pneumatic damper 354 to be mounted such that the mounting on the first bracket 328 is in the plane of the top of the first bracket 328.

The pneumatic damper 354 is connected to the rear of the console 310 such that the pneumatic damper 354 does not prevent movement of the first bracket 328 from a stowed position adjacent the casing 380 to a deployed position, as occurs in the first embodiment.

Instead of a pneumatic damper 354, a hydraulic or other suitable damper could alternatively be employed.

FIG. 14 shows a detail of the catch 370.

The first catch member 371 comprises a recess or hole 373 into which a protrusion 374 of the second catch member 372 protrudes to prevent any sheer movement between the first and second catch members 371, 372 when they are engaged. The second catch member 372 is biased in this position by a spring.

The second catch member 372 is coupled to the console top 314 by protrusions 377 which engage the underside of the console top 312 and allow a predetermined sliding movement of the second catch member 372 in the plane of the console top 312 towards and away from the console lid 314.

The protrusion 374 is released from the recess or hole 373 by sliding the second catch member 372 away from the first catch member such that the protrusion 374 disengages from the recess or hole 373 to allow the first catch member 371 to move upwardly with the lid 314. When released, the second catch member 372 returns to its biased position.

The second catch member 372 also comprises a locking mechanism 375. The locking mechanism 375 comprises a bar, which is rotatably mounted to the second catch member 372 at one end of the bar. The casing 380 has a hole 376, through which the locking mechanism 375 can pass when the bar is at a predetermined angle to the second catch member 372. The bar can then be rotated relative to the second catch member 372 once it has passed through the hole 376 in the casing 380. The rotation causes the bar of the locking mechanism 375 to overlap the casing 380 and prevent the second catch member 372 from sliding away from the first catch member 371, thereby locking the catch.

The locking mechanism 375 may be protected by use of a key latch.

Instead of a sliding second catch member 372, a pivoting second catch member could alternatively be employed. Additionally, the catch could be a key operated catch, the rotation of the lock with the, key releasing the first catch member from the second catch member.

The other aspects of the fourth embodiment are generally the same as those of the first embodiment. In particular, the opening and closing actions are generally the same as the first embodiment. The pneumatic damper 354 acts to slow the speed at which the lid 314 falls back from the opera position to the closed position.

The pneumatic damper 354 also comprises a spring (not shown) which causes the damper to bias the lid 314 to be slightly raised from the plane containing the console top 312. Thus, the opening action of the lid 314 is performed by disengaging the catch 370 by sliding the second catch member 372 away from the first catch member 371. This allows pneumatic damper 354 to return to its biased position where the lid 314 is slightly raised from the console top 312. The opening of the lid 314 then proceeds as described in the first embodiment.

The lid 314 is also closed in the same manner as in the first embodiment, except that the pneumatic damper 354 slows the speed at which the lid 314 falls back to the biased position slightly raised from the console top 312. Pressure on the lid 314 forces it flush with the console top 312. As the lid 314 is pushed down, first catch member 371 pushes second catch member 372 away from its biased position until protrusion 374 engages with recess or hole 373 and the second catch member 372 returns to its biased position.

The locking mechanism 375 can then be rotated to lock the catch 370.

Any discussion of the prior art throughout the specification is not an admission that such prior art is widely known or forms part of common general knowledge in the field.

Unless the content clearly requires otherwise, throughout the description and the claims, the words "comprise" and the like are used in an inclusive as opposed to an exclusive or exhaustive sense, that is to say, in the sense of "include, but not limited to."

The present invention has been described above purely by way of example, and modifications can be made within the spirit of the invention. The invention also consists in any individual features described or implicit herein or shown or implicit in the drawings or any combination of any such features or any generalization of any such features or combination. Each feature disclosed in the specification, including the claims, abstract and drawings, may be replaced by alternative features serving the same, equivalent or similar purposes, unless expressly stated otherwise.

The invention claimed is:

1. A console, comprising: a flat console top fixed in a horizontal orientation and defining a working surface of the console, the console top having an opening defined therethrough, by which a compartment within the console may be accessed, the console further comprising a first member configured to move within the compartment, and a second member designed to fit within the opening in the console top to form a portion of the working surface of the console when in a closed configuration, such that in the closed configuration the flat working surface of the flat console top and the second member together approximate a contiguous working surface of the console, the second member being moveably connected to the first member by a connecting member having a first pivot attached to the first member and a second pivot attached to the second member, wherein the first and second members are arranged to be movable between the closed configuration in which the first member is arranged in a stowed position and the second member closes the opening in it the console top to form the contiguous working surface of the console, and a open configuration in which the second member extends away from the console top to allow access to the first member or the compartment through the aperture in the console top.

2. The console of claim 1, wherein the connecting member provides a linkage between the first member and second member, the linkage being sized such that in the open configuration the first member is moved into the opening of the console top.

3. The console of claim 2, wherein when the first member is moved into the opening of the console top by the connecting member, the first member provides a usable working surface within the opening of the console top.

4. The console of claim 3, wherein the linkage is sized such that in the open configuration an upper surface of the first member is disposed at substantially the same height as a top surface of the console top.

5. The console of claim 1, wherein in the closed configuration the first member is arranged in a stowed position which is sufficiently below a bottom surface of the second member to enable a laptop computer to be stored on the first member below the second member.

6. The console of claim 1, wherein the connecting member is configured to cause coordinated relative movement between the first and second members such that movement of the second member from the closed configuration to the open configuration will cause controlled movement of the first member into the opening in the console top.

7. The console of claim 1, wherein in the closed configuration, an outer edge of the second member that is designed to fit within the opening in the console top to form a portion of the working surface of the console when in a closed configuration approximates, along at least along three edges, a portion of an inner edge of the opening in the console top.

8. The console of claim 1, wherein the first member has a flat top surface and an outer edge, and wherein in the open configuration the outer edge of the first member approximates a shape of the opening in the console top.

9. The console of claim 1, wherein the opening defines an opening into a recess in the console, and the stowed position of the first member is contained within the recess.

10. The console of claim 1, wherein the opening is defined on at least three sides by the console top.

11. A console, comprising:

a flat console top having a flat working surface that is fixed in a horizontal orientation and having an aperture defined therein; and first and second interconnected members configured to move in a coordinated manner via a linking mechanism pivotably connected at a first end with the first member and at a second end with the second member, such that movement of the second member will cause associated movement of the first member, the second member being movable between a closed position in which the second member fits into the aperture in the console top such that in the closed configuration the flat working surface of the flat console top and the second member together approximate a contiguous working surface and the first member is stowed below the second member, and an open position in which the second member extends away from the console top and the first member is moved into the aperture in the console top.

12. The console of claim 11, wherein the first member has a top surface and the console top has a top surface, the top surface defining the working surface of the console, and wherein when the first member is moved into the opening of the console top by the connecting member in the open position, the top surface of the first member is substantially coplanar with the top surface of the console top.

13. The console of claim 11, further comprising a damping mechanism configured to control a speed of movement of the second member when moving from the open position to the closed position.

* * * * *